US007635207B2

(12) United States Patent
Engel

(10) Patent No.: US 7,635,207 B2
(45) Date of Patent: Dec. 22, 2009

(54) RECESSED LIGHT

(75) Inventor: Hartmut S. Engel, Monrepos Strasse 7, Ludwigsburg (DE) 71634

(73) Assignee: Hartmut S. Engel, Ludwigsburg (DE)

( * ) Notice: Subject to any disclaimer, the term of this patent is extended or adjusted under 35 U.S.C. 154(b) by 109 days.

(21) Appl. No.: 11/574,663

(22) PCT Filed: Aug. 31, 2005

(86) PCT No.: PCT/EP2005/009385

§ 371 (c)(1),
(2), (4) Date: Mar. 2, 2007

(87) PCT Pub. No.: WO2006/027150

PCT Pub. Date: Mar. 16, 2006

(65) Prior Publication Data

US 2007/0230193 A1 Oct. 4, 2007

(30) Foreign Application Priority Data

Sep. 3, 2004 (DE) ..... 10 2004 042 802

(51) Int. Cl.
*F21V 15/00* (2006.01)

(52) U.S. Cl. ..... 362/365; 362/147; 362/148; 362/364; 362/368

(58) Field of Classification Search ..... 362/123, 362/147, 148, 364, 365, 368
See application file for complete search history.

(56) References Cited

U.S. PATENT DOCUMENTS

| | | | | |
|---|---|---|---|---|
| 3,919,542 | A * | 11/1975 | Castic | 362/267 |
| 4,510,559 | A | 4/1985 | Kristofek | |
| 2006/0245178 | A1 | 11/2006 | Engel | |

FOREIGN PATENT DOCUMENTS

| | | | |
|---|---|---|---|
| DE | G9205626.1 | | 7/1992 |
| DE | G9310757.9 | | 3/1994 |
| DE | 29501521.7 | | 4/1995 |
| DE | 20119829 | U1 | 2/2002 |
| DE | 10360947 | A1 | 12/2003 |
| DE | 202004000052 | U1 | 3/2004 |
| DE | 202004003710 | U1 | 5/2004 |
| DE | 10360647 | A1 | 7/2005 |
| DE | 102004042802 | A1 | 3/2006 |

* cited by examiner

*Primary Examiner*—Sandra L O'Shea
*Assistant Examiner*—Meghan K Dunwiddie
(74) *Attorney, Agent, or Firm*—Gifford, Krass, Sprinkle, Anderson & Citkowski, P.C.

(57) ABSTRACT

The invention relates to a recessed light provided with a light bulb socket and a reflector, which has an opening which is located in the main illumination direction and is covered by a transparent plate. An edge area of the reflector is arranged between the transparent plate and a fixing plate extending parallel thereto and comprising an opening for the reflector, wherein the relative position between the fixing plate and the transparent plate is fixed by a frame. The frame is flexible such that the fixing plate and/or transparent plate are exclusively detachable by deformation of the frame.

16 Claims, 4 Drawing Sheets

RECESSED LIGHT

CROSS REFERENCE TO RELATED APPLICATIONS

This application is a National Stage of International Application No. PCT/EP2005/009385, filed Aug. 31, 2005, and which claims the benefit of German Patent Application No. 10 2004 042 802.6, filed Sep. 3, 2004. The disclosures of the above applications are incorporated herein by reference.

FIELD OF THE INVENTION

The invention relates to a recessed light comprising a light bulb socket and a reflector which has an opening disposed in the main direction of illumination which is covered by a transparent plate, wherein a marginal region of the reflector is arranged between the transparent plate and a fixing plate extending parallel thereto and having an opening for the reflector and wherein the relative position between the fixing plate and the transparent plate is fixed by a frame.

BACKGROUND

The statements in this section merely provide background information related to the present disclosure and may not constitute prior art.

In recessed lights of the named kind known from the prior art, the transparent plate, the reflector and the fixing plate are, as a rule, connected to one another by comparatively complex and/or expensive measures, which has a negative effect on the economy of the manufacture of recessed lights of this kind. In addition, the connection elements which hold together the frame, the transparent plate, the reflector and the fixing plate can frequently only be operated in a complicated manner, sometimes using suitable tools, so that changing the named elements is difficult and complex and/or expensive, which ultimately increases the servicing effort to be made in connection with the known recessed lights in a disadvantageous manner.

SUMMARY

An object of the invention consists of further developing a recessed light of the initially named kind such that the reflector, the transparent plate and/or the fixing plate can be released from the recessed light or from the named frame in as simple a manner as possible and can optionally be replaced, with the manufacturing costs of the recessed light additionally being lowered.

This object is satisfied in accordance with the invention and, in particular, in that the frame is made so flexible that the fixing plate and/or the transparent plate are releasable from the frame only by a deformation thereof.

It is achieved in an advantageous manner by the flexible design of the frame in accordance with the invention which fixes the fixing plate relative to the transparent plate together with the reflector clamped between the plates that no additional components are required besides the elements of the frame, of the transparent plate, of the fixing plate and of the reflector anyway present to connect the named elements to one another. The frame rather holds together the fixing plate and the transparent plate so that they cannot move relative to one another or can only move insignificantly. It does, however, become possible in accordance with the invention to release the fixing plate, the transparent plate or both plates from the frame by a deformation of the frame so that the reflector clamped between the fixing plate and the transparent plate is released by this process. The said deformation of the frame accordingly has the effect that holding elements shaped on the frame and in particular made in one piece with it are moved relative to the plate to be released such that the respective plate becomes free.

With a recessed light in accordance with the invention, there is the need in certain applications to replace the reflector with another reflector, for example with a changed angle of radiation. It can equally be necessary to replace the fixing plate which e.g. effects a light scattering effect in order, for example, to generate a different lighting effect by a corresponding tint of the fixing plate. Finally, it can also be necessary to replace the transparent plate, for example, with a color filter in order thus also to be able to realize a respectively desired color with respect to the main illumination effected through the reflector opening. All these replacement procedures can be effected fast and simply in accordance with the invention.

It is specifically achieved inter alia in accordance with the invention that no separate holding elements have to be actuated for a release of the reflector from the recessed light, with in particular the use of a tool also being dispensable. Furthermore, a release and a fastening of the reflector from/to the recessed light can be effected in a very simple manner in a very short time. Finally, the principle in accordance with the invention can be realized particularly cost-effectively since only the material used for the flexible frame has to be selected accordingly and the frame simultaneously only has to be provided with holding elements for the fixing plate and for the transparent plate which can be shaped on the frame in a cost-effective manner.

It is particularly preferred for the frame, the transparent plate, the reflector and the fixing plate to be selectively replaceable in accordance with the invention, which is achieved when the four aforesaid elements are each made releasable from one another.

The frame can be made in the main direction of illumination with an inwardly projecting collar, in particular a peripheral collar, which forms an abutment surface for the marginal region of the transparent plate. The transparent plate is as a rule disposed behind the fixing plate and behind the reflector in the main direction of illumination so that it so-to-say forms the frontmost element of the recessed light. If the frame is now provided with the said collar in the main direction of illumination, the transparent plate is in contact therewith and is thus prevented from making a movement in the main direction of illumination.

It is particularly preferred when the frame is provided with at least two projections at its inner side which serve as holding elements for the fixing plate. These projections, which can be made without problem in one piece with the frame on its manufacture, come to lie directly behind the fixing plate against the main direction of illumination with the recessed light installed such that they are suitable to hold the unit of fixing plate, reflector and transparent plate in a defined position between the previously mentioned collar and the projections. The fixing plate is in particular prevented from making a movement against the main direction of illumination by the projections.

To facilitate the introduction of the fixing plate into the frame and thus the installation of the frame, of the transparent plate, of the reflector and of the fixing plate, the projections can be provided with a slope on their side remote from the collar of the frame. On the introduction of both the transport plate and the fixing plate, the flexible frame is then pressed outwardly over the slopes in the region of the projections so that both plates can be introduced into the frame without problem. After this introduction or after the fixing plate has passed the projections, the frame springs back into its original position due to its elasticity so that the projections snap in over the fixing plate and fix it together with the transparent plate between the collar and the projections.

It is preferred for the frame to be rectangular or square, with then a projection being provided at each side of the frame, in particular centrally. It is achieved by the provision of a projection on each side of the frame that the latter is practically torsionally stiff and thus particularly stable with an introduced plate and fixing plate. This stabilization effect in particular comes into effect when the transparent plate and/or the fixing plate is produced from a non-flexible, rigid material, for example of glass.

An interesting optical effect can be achieved when the fixing plate is made as a diffuser having light scattering properties. In this case, some of the amount of light delivered by a light bulb located in the reflector can exit from a reflector open to the rear against the main direction of illumination and can be directed by reflection from above onto the fixing plate. The fixing plate then appears diffusely radiant from below, whereby ultimately a diffuse light discharge region is defined which surrounds the reflector opening disposed in the main direction of illumination. Specific aspects and advantages of such an arrangement are described in the German patent application DE 103 60 947.4.

In accordance with the invention, the frame is preferably produced from thermally resistant plastic which is in particular heat resistant up to temperatures of 120° C. and more. It is thus reliably prevented that the frame is deformed as a consequence of the effect of heat.

Alternatively, the frame can, however, also be produced from metal, in particular from spring steel or stainless steel. In this case, the projections already explained above can consist, for example, of lugs for the holding of the fixing plate which are stamped out of metal and are bent in the direction of the inner side of the frame. The already explained slopes can also be generated automatically by such a bending and facilitate an introduction of the transparent plate and of the fixing plate into the frame.

The recessed light in accordance with the invention can be made as a built-in recessed light installed in a housing or as a downlight in which the frame holding the transparent plate, the reflector and the fixing plate can in turn be fastened in a frame holder on the housing side. It is preferred in this connection for the frame to be made releasable from the frame holder in order in this way to permit a simple change of the light bulb, for example. It is particularly advantageous in this case for the frame to be coupled with at least one flexible holding element which continues to connect the frame to the housing in its position released from the frame holder. It is thus prevented that a fitter has to handle a separate component, namely the frame with the elements located therein, when changing the light bulb. The frame can rather be let go by the fitter after a releasing from the housing since it continues to hang at the housing via the flexible holding element. At the end of the installation process, the frame hanging at the housing can simply be gripped again and connected to the housing.

Two flexible holding elements are preferably attached at one side of the frame so that it cannot rotate around a vertical axis with respect to the housing. The installation process following a change of light bulb, for example, is thereby facilitated since the frame already hangs in a largely correct position at the housing and can accordingly not be orientated incorrectly relative to the housing on the installation by the fitter.

It is particularly economic if the holding elements are shaped in one piece with the frame, with the frame in particular being able to be made as a plastic injection molded part. In this case, the frame, the holding elements and the projections present on the inner side of the frame can then be manufactured in a simple manner by means of a single injection process.

So that the holding elements are no longer visible with an installed frame, they can be pushed into the housing at their region remote from the frame on the installation. On being removed, in contrast, the holding elements are pulled out of the housing, with them, however, being fixed in their end position in the housing so that they cannot move fully out of the housing.

Further preferred embodiments are described in the dependent claims.

DRAWINGS

The drawings described herein are for illustration purposes only and are not intended to limit the scope of the present disclosure in any way.

DETAILED DESCRIPTION

Figure 1:
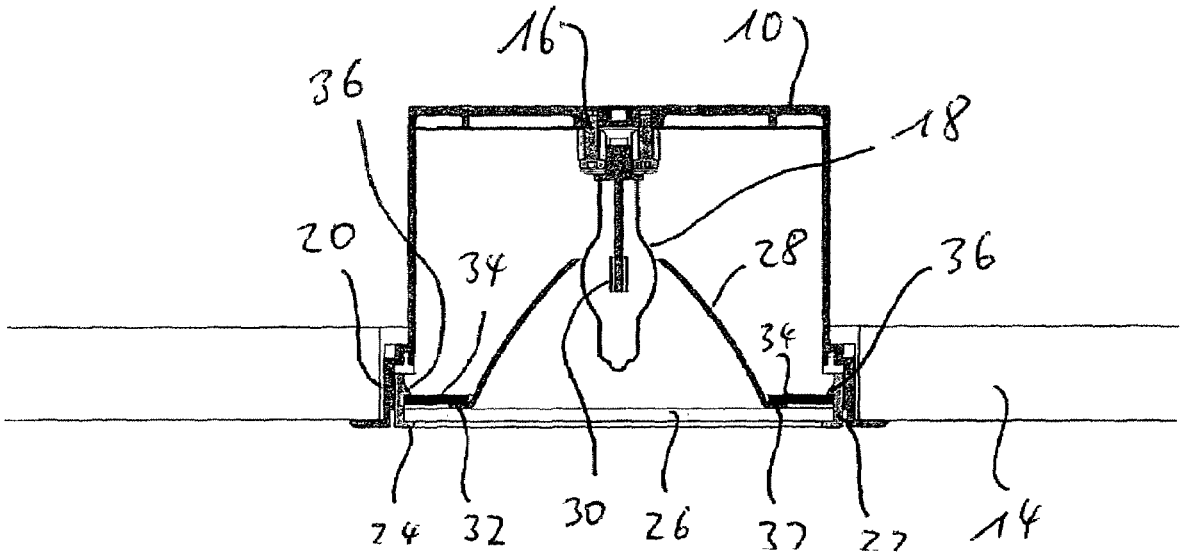
FIG. 1 illustrates a sectional view of a recessed light in accordance with the invention which is designed as a built-in recessed light or as a downlight.

The following description is merely exemplary in nature and is not intended to limit the present disclosure, application, or uses. It should be understood that throughout the drawings, corresponding reference numerals indicate like or corresponding parts and features.

Figure 2:
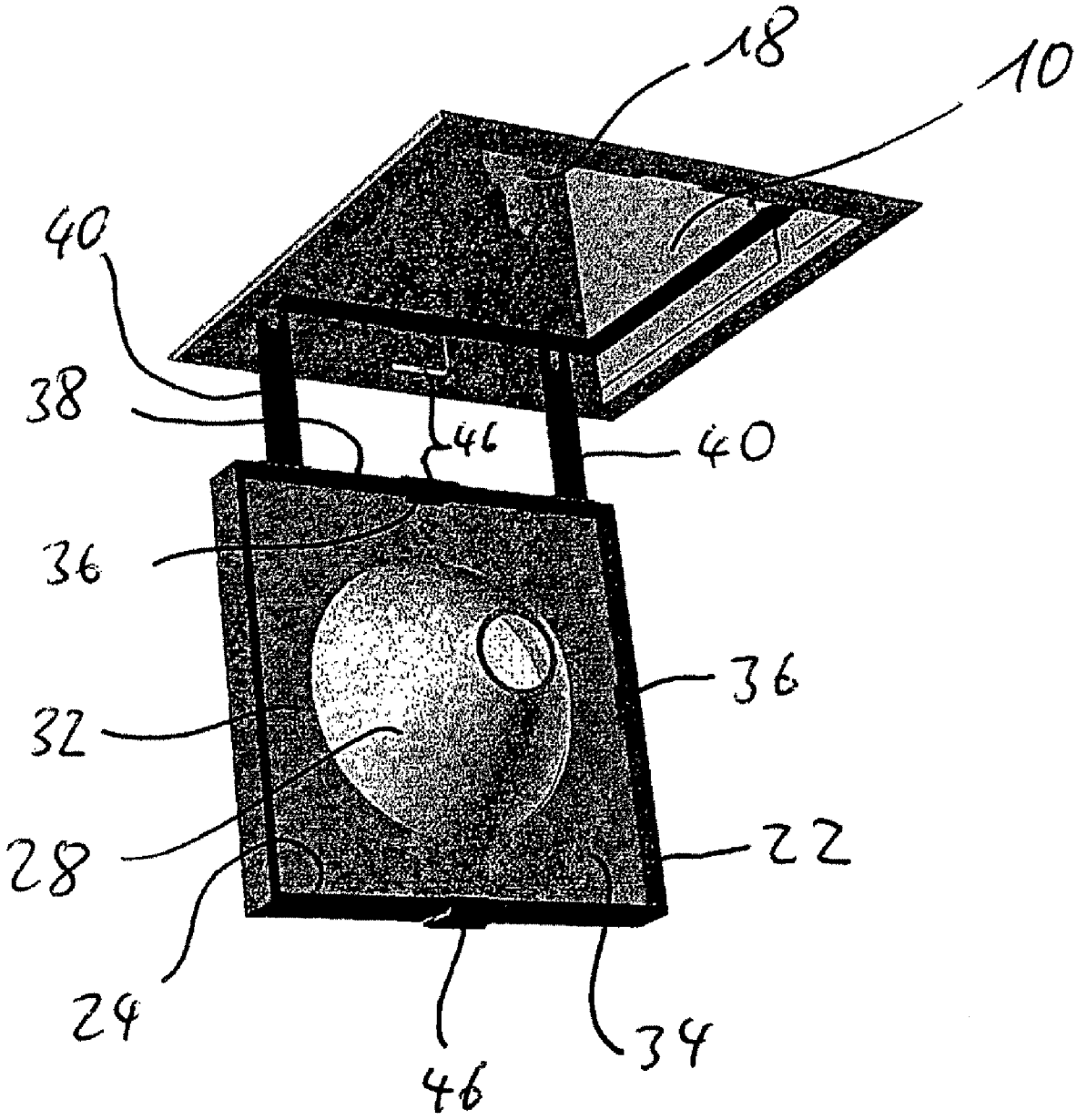
FIG. 2 illustrates a three-dimensional view of a downlight in accordance with FIG. 1 with a frame released from the housing.
Figure 3:
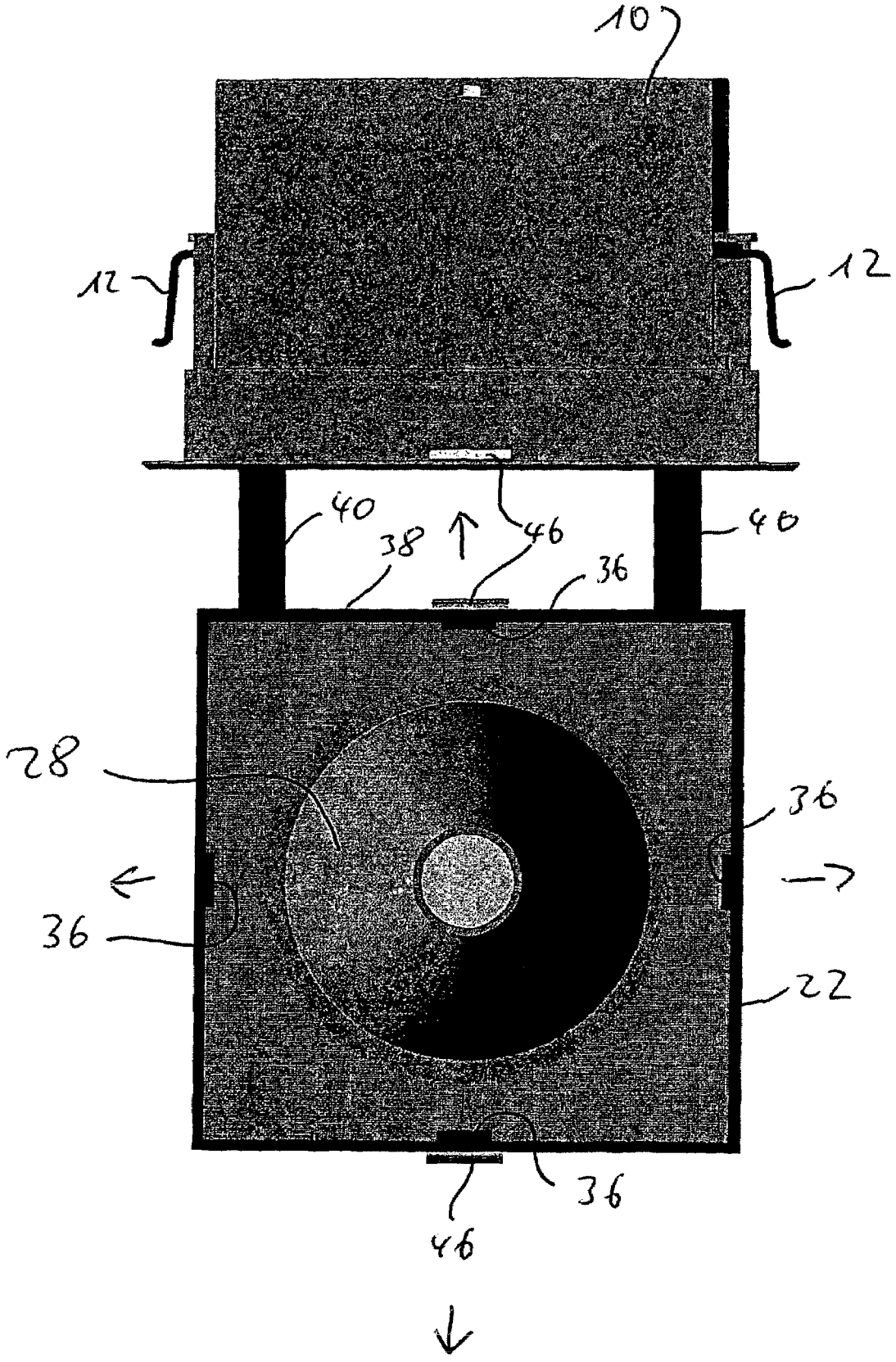
FIG. 3 illustrates the arrangement in accordance with FIG. 2 under a changed angle of view with a frontal plan view of the rear side of the frame.

FIGS. 1 to 3 show a housing 10 of a recessed light in accordance with the invention which is fixed in a ceiling element 14 (FIG. 1) with holding means 12 visible from FIG. 3 and not shown in FIG. 1 for reasons of clarity. A light bulb socket 16 is attached centrally to the housing base at the interior of the housing and a light bulb 18 is inserted into it.

The marginal region 20 of the housing opening is releasably coupled to a frame 22 which has a substantially square shape and which is provided with an inwardly projecting peripheral collar 24 at its marginal region remote from the housing 10.

A transparent plate 26 lies on the surface of the collar 24 facing the housing 10; it has the form of a square and has no apertures so that it can serve the dust-tight termination of the housing 10.

A dome-shaped reflector 28 is placed centrally on the surface of the transparent plate 26 facing the inner side of the housing 10 and has a large reflector opening disposed in the main direction of illumination and a rear smaller opening disposed against the main direction of illumination. Starting from the light bulb socket 16, the light bulb 18 projects through the smaller opening into the inner space of the reflector 28 so that the actual light generating element 30 of the light bulb 18 is located inside the reflector 28.

The dome-shaped reflector 28 is fitted in the region of its large opening disposed in the main direction of illumination with an outwardly facing, peripheral collar 32 which lies flat on a ring-shaped region of the transparent plate 26.

A fixing plate 34 lies on the surface of the collar 32 facing the inner space of the housing 10 and its outer contour corresponds to the outer contour of the transparent plate 26 which is, however, provided with a central circular cut-out for the reflector 28 so that—with the exception of the collar 32—the reflector 28 can be pushed through this cut-out. The collar 32 of the reflector 28 thus comes to lie between the transparent plate 26 and the inner marginal region of the fixing plate 34.

The fixing plate 34 is in turn now again fixed in its position by four projections 36 which are each located on the inner side of the frame 22. A respective projection 36 is provided centrally at each inner frame side in this connection. The projections 36 are provided at their side remote from the collar 24 of the frame 22 with a slope facilitating the introduction of the fixing plate 34 into the frame 22.

It can be seen from FIG. 1 that the transparent plate 26 and the fixing plate 34 is so-to-say clamped and thus fixed with the collar 32 of the reflector 28 located between these elements between the collar 24 of the frame 22 and the projections 36.

Figure 4:
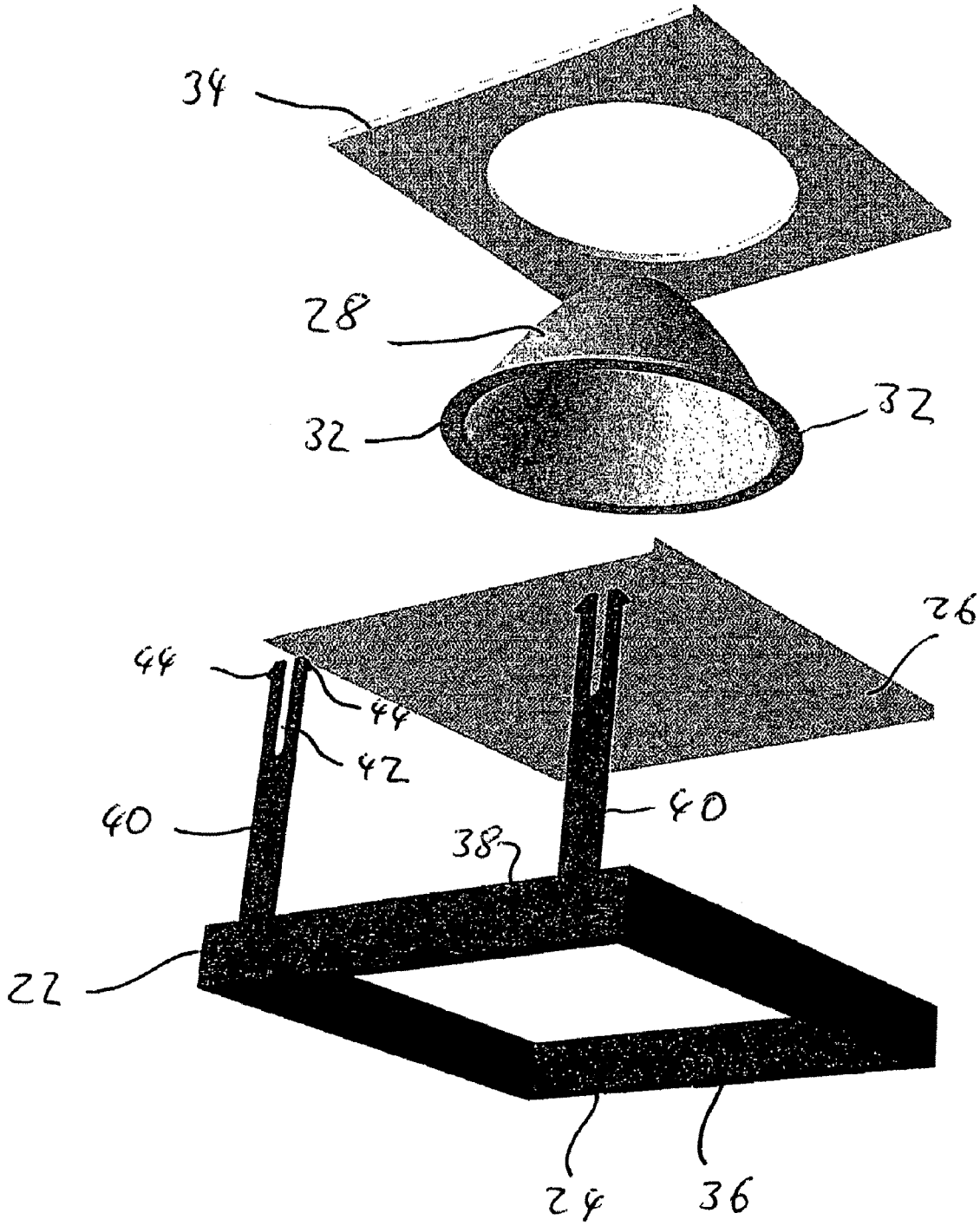
FIG. 4 illustrates a three-dimensional exploded representation of a frame with holding elements, a transparent plate, a reflector and a fixing plate such as can be used in a downlight in accordance with FIGS. 1 to 3.

Two lug-shaped bendable holding elements 40 which extend perpendicularly away from the frame side 38 are attached mutually spaced apart to a frame side 38. The holding elements 40 each have an elongate slit 42 (FIG. 4) at their end remote from the frame side 38 as well as two outwardly facing hook-like elements 44 which serve for the anchoring of the holding elements 40 in the housing 10.

The frame 22 can in turn be releasably latched in the housing 10 by means of a snap connection 46 (FIG. 2).

In the operation of the downlight in the installed state in accordance with FIG. 1, light moves from the rear opening of the reflector 28 into the inner space of the housing 10 which has reflecting properties at the inner side. Due to these reflecting properties, the light is inter alia reflected to the fixing plate 34 which can in particular have light scattering properties. In this case, the transparent plate 26 then appears radiant in that region in which it is arranged adjacent to the fixing plate 34. The large opening of the reflector 28 disposed in the main direction of illumination is thus surrounded by a diffuse light discharge region which is fixed by the fixing plate 34. The advantages achievable by such an arrangement are described in the already mentioned German patent application 103 60 947.4.

If the light bulb 18, for example, has to be changed in a downlight in accordance with FIGS. 1 to 4, the snap connection 46 must be released so that the frame 22 can be moved away from the housing 10. In this connection, the frame is, however, still fixed by the holding elements 40, which in this case can be pulled out of the housing 10 until the hook-shaped elements 44 block a further movement so that the fitter does not have to put the frame 22 to one side as a separate component or hold it in his hand. It is rather the case with a frame 22 hanging perpendicularly downwardly (FIGS. 2 and 3) that the frame 22 can be let go by the fitter so that he has both hands available to change the light bulb 18. If the frame 22 should be fixed to the housing 10 again after the change of the light bulb, the holding elements 40 are pushed into the housing again, the frame is pivoted upwardly by approximately 90° with respect to its position in accordance with FIGS. 2 and 3 and is subsequently latched in the housing 10 via the snap connection 46.

As already explained above, there is the need in specific applications with a downlight in accordance with the invention to replace the reflector 28, the light scattering fixing plate 34 or also the transparent plate 26.

In all these cases, in accordance with the invention, the frame 22 is released from the housing 10 in the already explained manner. Subsequently to this, all four frame sides can then be lightly pressed outwardly in the direction of the arrows drawn in FIG. 3 so that the projections 36 no longer come to lie over the fixing plate 34 and the fixing plate 34 is ultimately released. A movement of the frame sides in the arrow direction is possible because, in accordance with the invention, the frame 22 is flexible, optionally also stretchable. If the frame 22 can only be bent, but not stretched, it is necessary to dimension the transparent plate 26 and the fixing plate 34 so that a specific gap remains between these plates 26, 34 and the inner side of the frame, said gap then permitting a movement of the frame sides in the arrow direction.

After the fixing plate 34 has been released in the described manner, it can be removed from the frame 22 so that the reflector 28 whose collar 32 is now no longer fixed can also be removed. The transparent plate 26 can also be removed from the frame 22 when the frame sides are moved in the arrow direction in accordance with FIG. 3.

If the named elements 26, 28, 34 should subsequently be introduced into the frame 22 again, the frame sides are automatically pressed outwardly over the slopes of the projections 36 in the direction of the arrows in accordance with FIG. 3 so that the transparent plate 26 and the fixing plate 34 ultimately latch beneath the projections 36 and are then again fixed between the projections 36 and the collar 24 of the frame 22.

The description is merely exemplary in nature and, thus, variations that do not depart from the gist of the present disclosure are intended to be within the scope of the invention. Such variations are not to be regarded as a departure from the spirit and scope of the present disclosure.

REFERENCE NUMERAL LIST

10 housing
12 holding means
14 ceiling element
16 light bulb socket
18 light bulb
20 marginal region
22 frame
24 collar
26 transparent plate
28 reflector
30 light generating element
32 collar
34 fixing plate
36 projections
38 frame side
40 holding elements
42 elongate slits
44 hook-shaped elements
46 snap connection

What is claimed is:

1. A recessed light, comprising:

a light bulb socket (16); and a reflector (28), which has an opening disposed in the main direction of illumination which is covered by a transparent plate (26), wherein a marginal region (32) of the reflector (28) is arranged between the transparent plate (26) and a fixing plate (34) extending parallel thereto and having an opening for the reflector (28) and wherein the relative position between the fixing plate (34) and the transparent plate (26) is fixed by a frame (22), and wherein the complete frame (22) is made flexible and in particular consists completely of a homogeneous flexible material so that at least one of the fixing plate (34) and the transparent plate (26) are only releasable from the frame (22) by a deformation thereof.

2. A recessed light in accordance with claim 1, wherein the frame (22), the transparent plate (26), the reflector (28) and the fixing plate (34) are releasable from one another.

3. A recessed light in accordance with claim 1, wherein the frame (22) is made in the main direction of illumination with a collar (24), which is in particular peripheral, projects inwardly and forms a contact surface for the marginal region of the transparent plate (26).

4. A recessed light in accordance with claim 1, wherein the frame (22) is provided on its inner side with at least two projections (36), which serve as holding elements for the fixing plate (34).

5. A recessed light in accordance with claim 4, wherein the projections (36) are provided on their side remote from the collar (24) with a slope facilitating the introduction of the fixing plate (34).

6. A recessed light in accordance with claim 4 wherein the frame (22) is made one of rectangular and square, with a projection (36) being provided, in particular centrally, at each side of the frame (22).

7. A recessed light in accordance with claim 1, wherein the fixing plate (34) is made as a diffuser having light scattering properties.

8. A recessed light in accordance with claim 1, wherein the frame (22) consists of thermally resistant plastic, which is heat resistant up to at least temperatures of 120° C.

9. A recessed light in accordance with claim 1, wherein the frame (22) consists of metal, in particular of one of spring sheet metal and stainless steel sheet metal.

10. A recessed light in accordance with claim 9, wherein the projections consist of lugs, which are stamped out of the metal and are bent in the direction of the inner side of the frame.

11. A recessed light in accordance with claim 1, wherein the recessed light is made as a built in recessed light (downlight) installed in a housing (10) and the frame (22) can be fastened in a frame holder.

12. A recessed light in accordance with claim 11, wherein the frame (22) is made releasable from the frame holder.

13. A recessed light in accordance with claim 12, wherein the frame (22) is coupled to at least one flexible holding element (40) which continues to connect the frame (22) to the housing (10) in its position released from the frame holder.

14. A recessed light in accordance with claim 13, wherein two holding elements (40) are attached to a side of the frame (2).

15. A recessed light in accordance with claim 14, wherein the holding elements (40) are shaped in one piece with the frame (22), with the frame (22) in particular being made as a plastic injection molded part.

16. A recessed light in accordance with claim 15, wherein the holding element/holding elements (40) can be pushed into the housing (10) with its/their region remote from the frame (22).

* * * * *